US011639566B2

(12) United States Patent
Lee et al.

(10) Patent No.: US 11,639,566 B2
(45) Date of Patent: May 2, 2023

(54) METHOD FOR KNITTING THREE-DIMENSIONAL FABRIC WITH VARIABLE THICKNESS THROUGH A FLAT KNITTING MACHINE

(71) Applicant: PAI LUNG MACHINERY MILL CO., LTD., New Taipei (TW)

(72) Inventors: Chih-Chiang Lee, New Taipei (TW); Jeng-Pin Cheng, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 436 days.

(21) Appl. No.: 16/287,245

(22) Filed: Feb. 27, 2019

(65) Prior Publication Data

US 2020/0270780 A1 Aug. 27, 2020

(51) Int. Cl.

| | |
|---|---|
| ***D04B 7/30*** | (2006.01) |
| ***D04B 7/04*** | (2006.01) |
| ***D04B 7/20*** | (2006.01) |
| ***D04B 15/36*** | (2006.01) |
| *D06C 15/10* | (2006.01) |
| *D04B 37/02* | (2006.01) |
| *D04B 37/06* | (2006.01) |

(52) U.S. Cl.

CPC ..... *D04B 7/30* (2013.01); *D04B 7/04* (2013.01); *D04B 7/20* (2013.01); *D04B 15/362* (2013.01); *D04B 15/367* (2013.01); *D04B 37/02* (2013.01); *D04B 37/06* (2013.01); *D06C 15/10* (2013.01)

(58) Field of Classification Search

CPC ..... D06C 15/10; D04B 37/02; D04B 37/06; D04B 7/30; D04B 7/04; D04B 7/20; D04B 15/362; D04B 15/367

USPC ..... 66/77, 147

See application file for complete search history.

(56) References Cited

U.S. PATENT DOCUMENTS 4,546,623 A * 10/1985 Kuhn ..... D04B 15/06 66/54

4,989,421 A * 2/1991 Schmidt ..... D04B 1/02 66/93

(Continued)

FOREIGN PATENT DOCUMENTS

CN 102704180 A 10/2012

CN 102978823 A 3/2013

(Continued)

*Primary Examiner* — Danny Worrell

*Assistant Examiner* — Dakota Marin

(74) *Attorney, Agent, or Firm* — Muncy, Geissler, Olds & Lowe, P.C.

(57) ABSTRACT

A method for knitting a three-dimensional fabric with variable thickness through a flat knitting machine includes the following steps: moving two cam groups and driving a plurality of knitting needles to knit a first piece of knitting by a starting cam system; moving the two cam groups and driving the plurality of knitting needles to knit a second piece of knitting by a middle cam system; and moving the two cam groups and driving the plurality of knitting needles to knit a supporting yarn by two tail cam systems respectively. The tail cam systems control each of a plurality of knock-over bit cams to move according to a gap size corresponding to a knitting length of the supporting yarn, so as to promptly change a thickness of the three-dimensional fabric along the length change of the supporting yarn.

5 Claims, 6 Drawing Sheets

(56) References Cited

U.S. PATENT DOCUMENTS

| | | | | | |
|---|---|---|---|---|---|
| 5,557,948 | A * | 9/1996 | Shima | D04B 1/12 | 66/106 |
| 6,014,874 | A * | 1/2000 | Shima | D04B 15/10 | 66/106 |
| 6,079,233 | A * | 6/2000 | Shima | D04B 15/362 | 66/106 |
| 6,415,633 | B2 * | 7/2002 | Schmid | D04B 15/10 | 66/64 |
| 6,779,369 | B2 * | 8/2004 | Shepherd | D04B 1/126 | 66/193 |
| 6,799,443 | B2 * | 10/2004 | Morita | D04B 7/04 | 66/64 |
| 7,739,888 | B2 * | 6/2010 | Sciacca | D04B 23/16 | 66/208 |
| 11,299,829 | B2 * | 4/2022 | Meir | D04B 15/362 | |
| 2004/0031292 | A1 * | 2/2004 | Morita | D04B 15/362 | 66/64 |
| 2014/0310983 | A1 * | 10/2014 | Tamm | A43B 23/024 | 36/83 |
| 2019/0231021 | A1 * | 8/2019 | Hoying | A43B 23/0265 | |

FOREIGN PATENT DOCUMENTS

| | | | | | |
|---|---|---|---|---|---|
| CN | 105220347 | A | | 1/2016 | |
| CN | 111501178 | B | * | 5/2022 | D04B 1/22 |
| EP | 672769 | A1 | * | 9/1995 | D04B 15/06 |
| EP | 1340847 | A1 | * | 9/2003 | D04B 15/06 |
| EP | 3034665 | A1 | * | 6/2016 | D04B 15/90 |
| TW | 202028555 | A | * | 8/2020 | |

* cited by examiner

METHOD FOR KNITTING THREE-DIMENSIONAL FABRIC WITH VARIABLE THICKNESS THROUGH A FLAT KNITTING MACHINE

FIELD OF THE INVENTION

The present invention relates to a method for knitting a three-dimensional fabric, and particularly relates to a method for knitting a three-dimensional fabric with variable thickness through a flat knitting machine.

BACKGROUND OF THE INVENTION

The existing knitting of a three-dimensional fabric with variable thickness is generally realized by a warp knitting machine, as disclosed in patents of CN 102704180A, CN 102978823A and CN 105220347A.

However, the problem that the existing flat knitting machine cannot knit the foregoing mentioned fabric results from the flat knitting machine is defined by fixed knock-over bits, which is causing that the flat knitting machine can only knit the three-dimensional fabric with a single thickness.

SUMMARY OF THE INVENTION

The main purpose of the present invention is to solve the problem that the existing flat knitting machine cannot knit the three-dimensional fabric with variable thickness.

To achieve the above purpose, the present invention provides a method for knitting a three-dimensional fabric with variable thickness through a flat knitting machine, including the following steps:

step (1): moving two cam groups onto two needle beds which are disposed relatively, and driving a plurality of needles to knit a first piece of knitting by a starting cam system included in one of the two cam groups;

step (2): moving the two cam groups onto the two needle beds which are disposed relatively, and driving the plurality of knitting needles to knit a second piece of knitting by a middle cam system included in the other one of the two cam groups;

step (3): moving the two cam groups onto the two needle beds which are disposed relatively, and driving the plurality of knitting needles to knit a supporting yarn by two tail cam systems respectively included in the two cam groups, wherein two ends of the supporting yarn are respectively interwoven with the first piece of knitting and the second piece of knitting, and moving each of a plurality of knock-over bit cams controlled by each of the tail cam systems which depends on a gap size corresponding to a knitting length of the supporting yarn, so as to promptly change a thickness of the three-dimensional fabric along the length change of the supporting yarn in a knitting process; and step (4): repeating the step (1) to the step (3) to complete the three-dimensional fabric.

In an embodiment, the step (3) includes a substep: controlling a flat knitting machine yarn feeder to adjust a position of a yarn feeding arm in the gap according to the gap size.

In an embodiment, the step (4) includes a substep: controlling the starting cam system and the middle cam system of the other one of the plurality of knock-over bit cam to implement displacement and adjustment according to the gap size after the previous step.

In an embodiment, the step (4) includes a substep: controlling the flat knitting machine yarn feeder to adjust the position of the yarn feeding arm in the gap based on the gap size after the previous step.

In an embodiment, the step (4) includes a substep: controlling at least one flat knitting machine mangling device to adjust a mangling position based on the gap size after the previous step.

As previously disclosed in the present invention, compared with the prior art, the present invention comprises the following characteristics: the method disclosed in the present invention enables the flat knitting machine to achieve the knitting of the three-dimensional fabric with variable thickness.

DETAILED DESCRIPTION OF THE PREFERRED EMBODIMENTS

Figure 1:
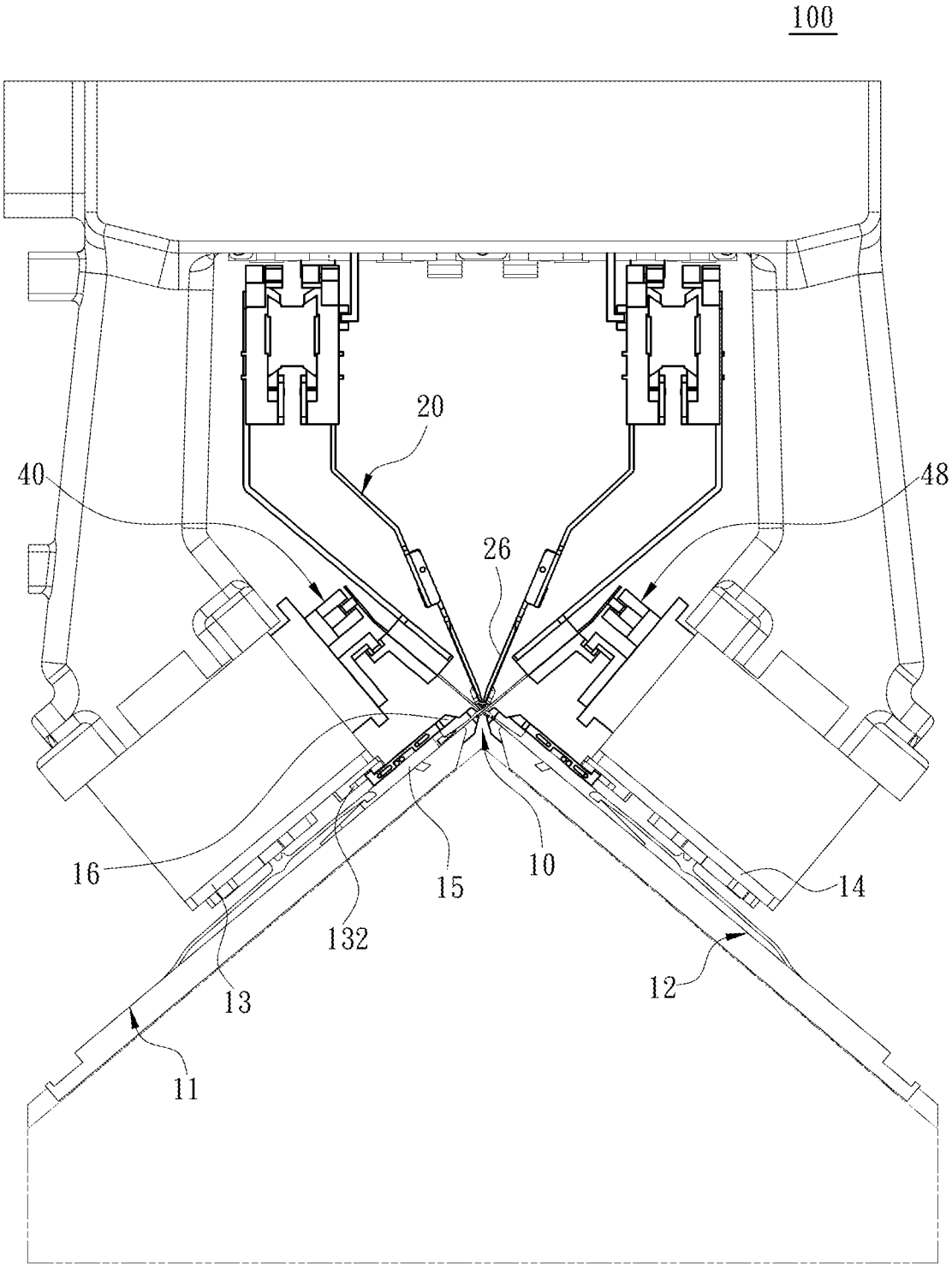
FIG. 1 is a structural schematic diagram of a flat knitting machine in an embodiment of the present invention.

The details and technical contents of the present invention will be described below with reference to drawings.

By referring to FIGS. 1, 2, 3, 4 and 5, the present invention provides a method 500 for knitting a three-dimensional fabric with variable thickness through a flat knitting machine. Before the method is described, a flat knitting machine structure 100 of the present invention is described. A gap 10 of the present invention is defined by a plurality of knock-over bits 16 facing each other in two needle beds 11 and 12 which are disposed in the flat knitting machine structure 100. The flat knitting machine structure 100 includes a plurality of cam systems 13 and 14 for changing a gap size, a plurality of flat knitting machine yarn feeders 20 change yarn feeding positions according to the gap size, and a plurality of flat knitting machine mangling devices 40 and 48 change mangling positions according to the gap size. The plurality of cam systems 13 (or 14) are used in a single knitting procedure. In a knitting process, a plurality of knitting needles 15 and the plurality of knock-over bits 16 on each of the needle beds 11 (or 12) are respectively controlled by each of the plurality of cam systems 13 (or 14). Each of the plurality of cam systems 13 (or 14) comprises at least one knock-over bit cam 132 to control the plurality of knock-over bits 16. The knock-over bit cam 132 changes the positions of the plurality of knock-over bits 16 in the knitting process, and the flat knitting machine promptly changes the gap size in the knitting process according to knitting requirements. Moreover, the plurality of cam systems 13 (or 14) are sequentially assembled into a cam group 18 (or 19). Further, the cam group 18 of the present invention is formed by three of the cam systems 13. According to a motion direction of a machine head of the flat knitting machine, the three of the cam systems 13 are defined as a starting cam system 181, a middle cam system 182 and a tail cam system 183 in sequence. However, the flat knitting machine belongs to a weft knitting machine. The motion direction of the machine head is reverse displacement but not one-way. Briefly, the machine head displaces repeatedly along a straight track, as shown in directions 590 and 591 in FIGS. 2 and 3. Therefore, the cam systems 13 defined as the starting cam system 181 in the previous knitting process would be defined as the tail cam system 183 is in the next knitting process. In addition, the other one of the cam groups 19 also comprises three of the cam systems 14 defined as a starting cam system 191, a middle cam system 192 and a tail cam system 193.

Figure 6:
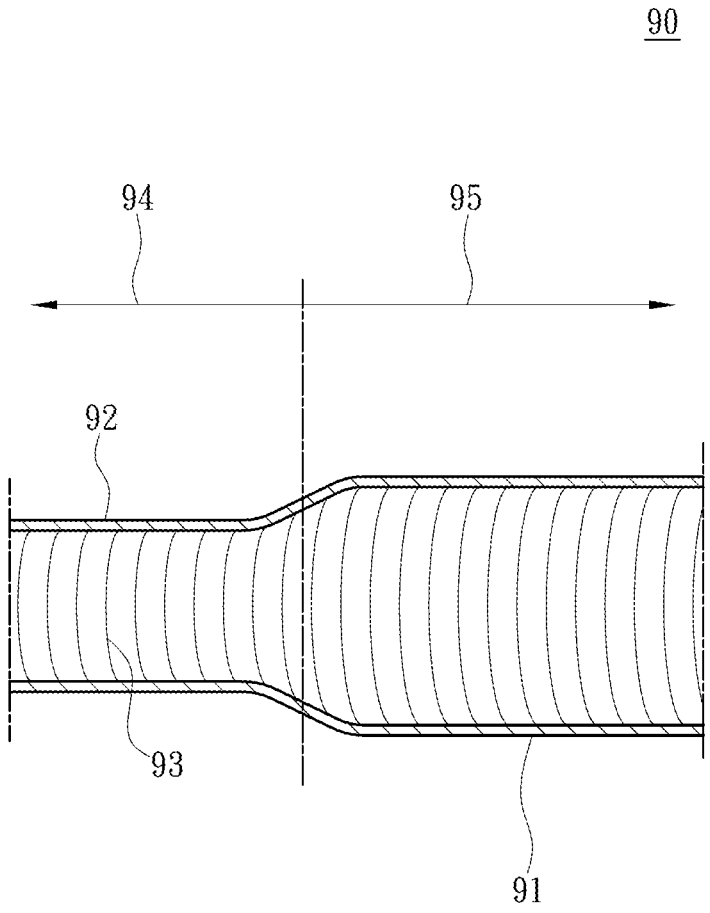
FIG. 6 is a schematic diagram of a three-dimensional fabric in an embodiment of the present invention.

In another aspect, by referring to FIG. 6, the three-dimensional fabric 90 of the present invention is formed by a first piece of knitting 91, a second piece of knitting 92 which is spaced from the first piece of knitting 91, and a supporting yarn 93 which is separately interwoven with the first piece of knitting 91 and the second piece of knitting 92, wherein the supporting yarn 93 may be a nylon yarn. The height of the supporting yarn 93 is the thickness of the three-dimensional fabric 90. By referring to FIG. 6, the figure shows that the three-dimensional fabric 90 with variable thickness. The thickness is thinner upon knitting in the previous knitting process 94, and the thickness is thicker upon knitting in the subsequent knitting process 95.

By referring to FIGS. 1, 2, 3 and 4, the method 500 includes the following steps:

step (1) 51: moving the two cam groups 18 and 19 onto two needle beds 11 and 12 which are disposed relatively, and driving the plurality of knitting needles 15 to knit the first piece of knitting 91 by the starting cam system 181 (or 191) included in one of the two cam groups 18 (or 19);

step (2) 52: moving the two cam groups 18 and 19 onto the two needle beds 11 and 12 which are disposed relatively, and driving the plurality of knitting needles 15 to knit the second piece of knitting 92 by the middle cam system 192 (or 182) included in the other one of the two cam groups 19 (or 18);

step (3) 53: moving the two cam groups 18 and 19 onto the two needle beds 11 and 12 which are disposed relatively, and driving the plurality of knitting needles 15 to knit the supporting yarn 93 by the tail cam systems 183 and 193 respectively included in the two cam groups 18 and 19, wherein the two ends of the supporting yarn 93 are respectively interwoven with the first piece of knitting 91 and the second piece of knitting 92, and moving each of a plurality of knock-over bit cams 132 controlled by each of the tail cam systems 183 (or 193) which depends on a gap size corresponding to a knitting length of the supporting yarn 93, so as to promptly change the thickness of the three-dimensional fabric 90 along the length change of the supporting yarn 93 in a knitting process; and step (4) 54: repeating the step (1) 51 to the step (3) 53 to complete the three-dimensional fabric 90.

Figure 2:
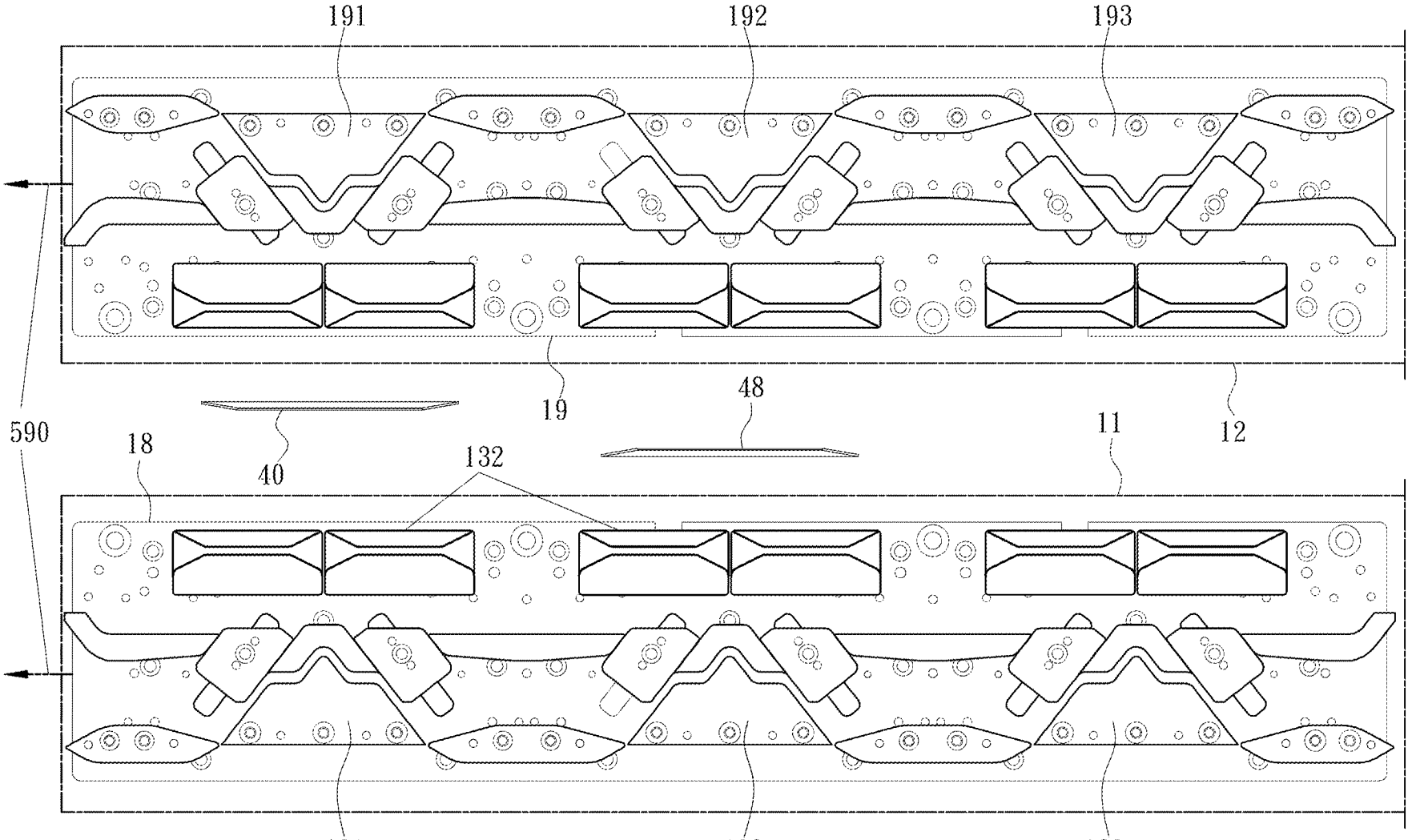
FIG. 2 is an implementation diagram (I) when two cam groups conduct knitting in an embodiment of the present invention.

Referring to FIG. 2, it is assumed that the current knitting direction of the machine head is indicated by 590 in the figure. In the step (1) 51, the two cam groups 18 and 19 are controlled to simultaneously move relative to the two needle beds 11 and 12. At this moment, the starting cam system 181 of the cam group 18 drives part of the plurality of knitting needles 15 on the needle bed 11 to accept yarn feeding to knit the first piece of knitting 91. Moreover, when the first piece of knitting 91 is knitted by the starting cam system 181, the flat knitting machine mangling device 40 disposed correspondingly to the cam group 19 performs a mangling action.

Then, the two cam groups 18 and 19 make displacement continuously, and the middle cam system 192 of the other one of the cam groups 19 drives part of the plurality of knitting needles 15 on the needle bed 12 to accept yarn feeding to knit the second piece of knitting 92. Further, the plurality of knitting needles 15 on the needle bed 12 knit the second piece of knitting 92, which are disposed in opposition to the plurality of knitting needles 15 on the needle bed 11 to knit the first piece of knitting 91. Furthermore, when the second piece of knitting 92 is knitted by the middle cam system 192, the flat knitting machine mangling device 48 disposed correspondingly to the cam group 18 performs a mangling action. Based on this, the step (3) 53 is conducted after the second piece of knitting 92 is completed. The two cam groups 18 and 19 make displacement continuously, and the two tail cam systems 183 and 193 simultaneously drive the plurality of knitting needles 15 of the two needle beds 11 and 12, and accept yarn feeding to knit the supporting yarn 93, wherein the two ends of the supporting yarn 93 are respectively interwoven with the first piece of knitting 91 and the second piece of knitting 92. Furthermore, in the implementation process of the step (3) 53, the knock-over bit cams 132 of the two tail cam systems 183 and 193 make displacement according to the set length of the supporting yarn 93, i.e., the two tail cam systems 183 and 193 promptly adjust the gap size according to the set length of the supporting yarn 93 in the knitting process. When the supporting yarn 93 is shorter, the gap size is smaller for knitting. When the supporting yarn 93 is longer, the gap size is larger for knitting. Furthermore, the knock-over bit cams 132 of the two tail cam systems 183 and 193 respectively accept the control of a control device, wherein the control device controls according to a pre-memory knitting process.

Figure 3:
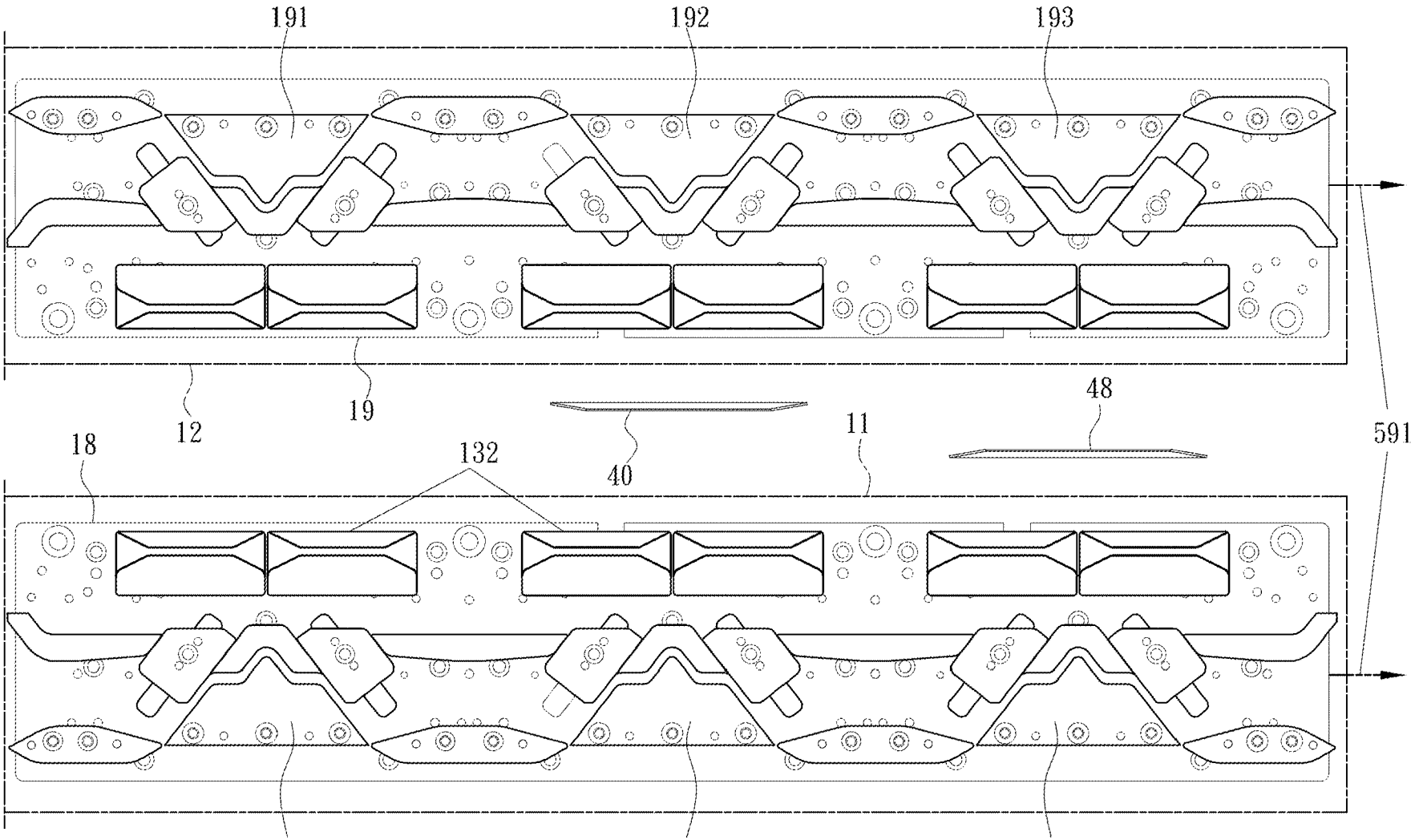
FIG. 3 is an implementation diagram (II) when two cam groups conduct knitting in an embodiment of the present invention.

Based on this, the step (4) 54 is conducted after the step (3) 53 is completed. If the machine head travels to the end at the time, the machine head displaces reversely, as shown in FIG. 3. Meanwhile, the two starting cam systems 181 and 191 of the two cam groups 18 and 19 are replaced by the tail cam systems 183 and 193 in the previous knitting process to be used as the starting cam systems 181 and 191 in this knitting process. Similarly, the starting cam systems 181 and 191 in the previous knitting process are used as the tail cam systems 183 and 193 in this knitting process. Next, the step (1) 51 to the step (3) 53 are conducted again until the three-dimensional fabric 90 is accomplished. The implementation process of the step (1) 51 to the step (3) 53 is described previously, and will not be repeated herein.

Figure 4:
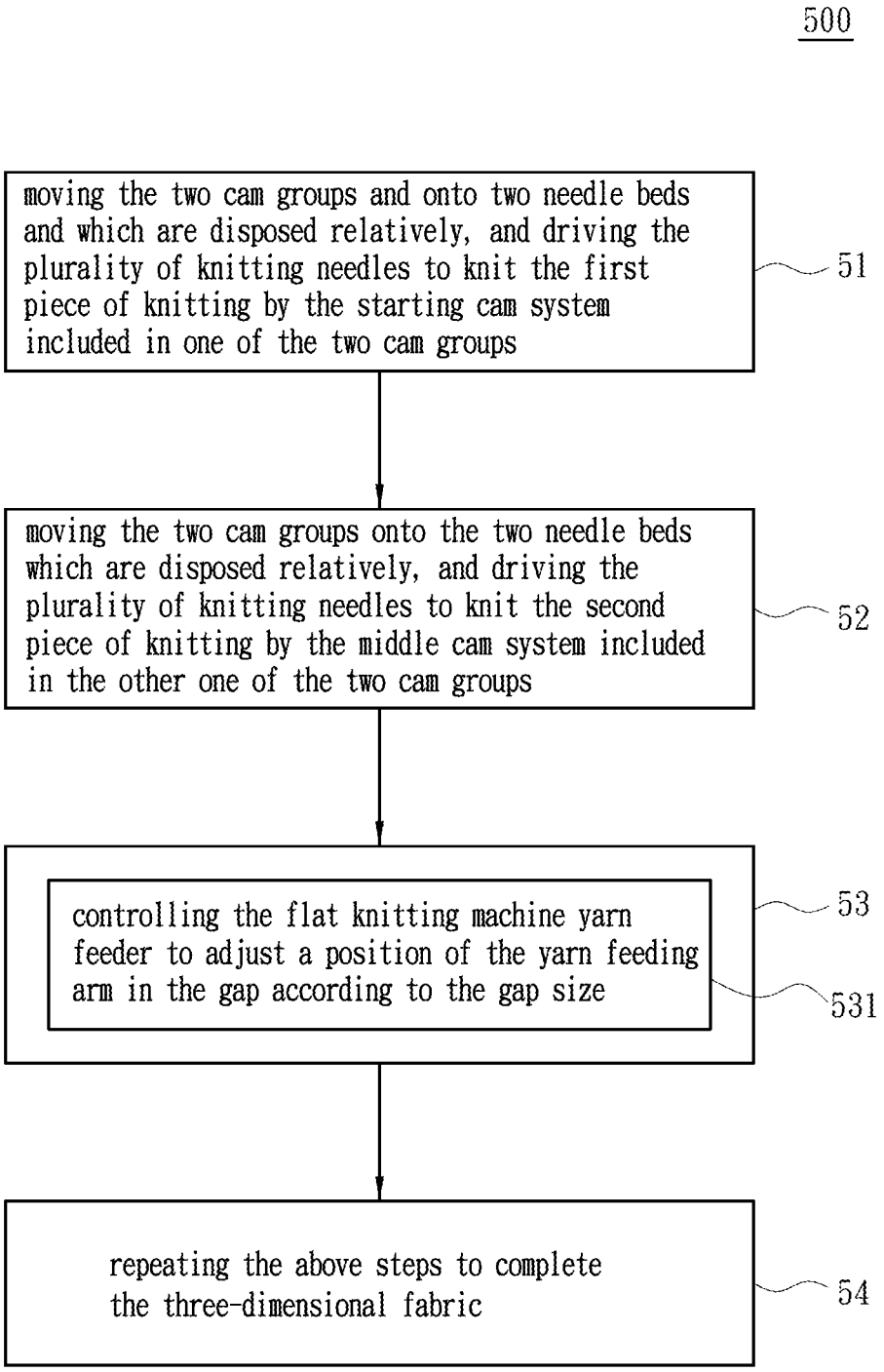
FIG. 4 is a flow chart of a method in an embodiment of the present invention.

Referring to FIG. 4, in an embodiment, the step (3) 53 includes a substep 531: controlling the flat knitting machine yarn feeder 20 to adjust a position of the yarn feeding arm 26 in the gap 10 according to the gap size. Thus, the plurality of knitting needles 15 does not generate problems such as abnormal yarn snagging due to the change of the gap 10 in the process of the step (3) 53.

Figure 5:
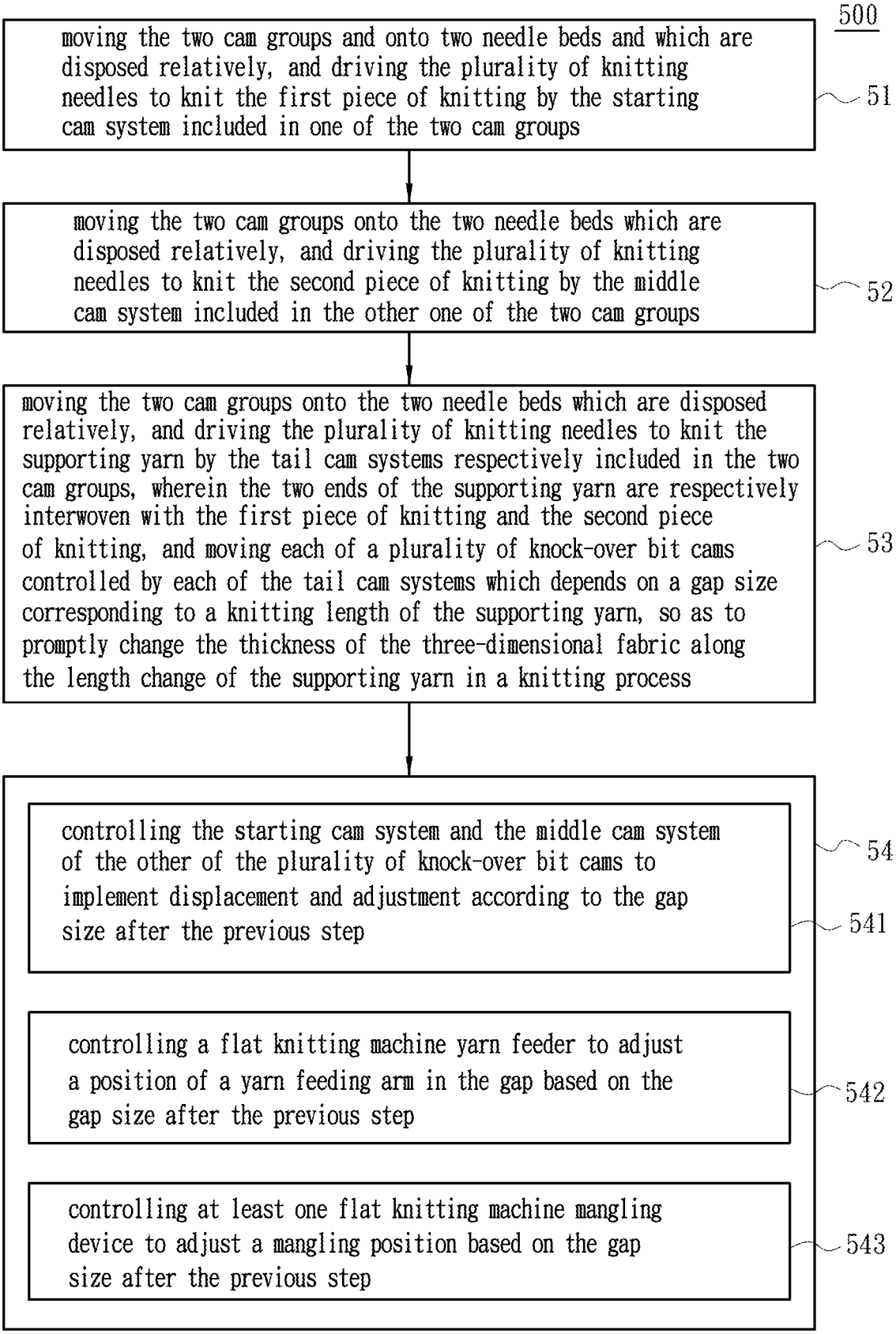
FIG. 5 is a flow chart of a method in another embodiment of the present invention.

Referring to FIG. 5, the subsequent knitting process 95 coordinates with the change of the gap 10 in the previous knitting process 94. In an embodiment, the step (4) 54 includes a substep 541: controlling the starting cam systems 181 and 191 and the middle cam systems 182 and 192 of the other of the knock-over bit cams 132 to implement displacement and adjustment according to the gap size after the previous step. In addition, the step (4) 54 includes a substep 542: controlling the flat knitting machine yarn feeder 20 to adjust the position of the yarn feeding arm 26 in the gap 10 based on the gap size after the previous step. Further, the step (4) 54 includes a substep 543: controlling at least one flat knitting machine mangling device 40 (or 48) to adjust a mangling position based on the gap size after the previous step.

In conclusion, the foregoing mentioned structure and the method in the present invention allow that the flat knitting machine is not limited to implement a single thickness but variable thickness according to the design of the three-dimensional fabric 90 in the knitting process.

What is claimed is:

1. A method for knitting a three-dimensional fabric with variable thickness through a flat knitting machine, comprising the following steps:

step (1): moving two cam groups onto two needle beds which are disposed relatively, and driving a plurality of knitting needles to knit a first piece of knitting by a starting cam system included in one of the two cam groups;

step (2): moving the two cam groups, and driving the plurality of knitting needles to knit a second piece of knitting by a middle cam system included in the other one of the two cam groups;

step (3): moving the two cam groups, and driving the plurality of knitting needles to knit a supporting yarn by two tail cam systems respectively included in the two cam groups, wherein two ends of the supporting yarn are respectively interwoven with the first piece of knitting and the second piece of knitting, and a required knitting length of the supporting yarn is determined by a thickness of the three-dimensional fabric, moving each of a plurality of knock-over bit cams controlled by each of the tail cam systems in a knitting process to shift positions of two sets of knock-over bits respectively provided on the two needle beds, and changing a gap size defined by a distance between the two sets of knock-over bits of the two needle beds according to the required knitting length of the supporting yarn in the knitting process, so as to promptly change the knitting length of the supporting yarn and the thickness of the three-dimensional fabric; and step (4): repeating the step (1) to the step (3) to complete the three-dimensional fabric.

2. The method for knitting the three-dimensional fabric with variable thickness through the flat knitting machine of claim 1, wherein the step (3) comprises a substep: controlling a flat knitting machine yarn feeder to adjust a position of a yarn feeding arm in the gap according to the gap size.

3. The method for knitting the three-dimensional fabric with variable thickness through the flat knitting machine of claim 1, wherein the step (4) comprises a substep: controlling the starting cam system and the middle cam system of the other of the plurality of knock-over bit cams to implement displacement and adjustment according to the gap size after the previous step.

4. The method for knitting the three-dimensional fabric with variable thickness through the flat knitting machine of claim 3, wherein the step (4) comprises a substep: controlling a flat knitting machine yarn feeder to adjust a position of a yarn feeding arm in the gap based on the gap size after the previous step.

5. The method for knitting the three-dimensional fabric with variable thickness through the flat knitting machine of claim 4, wherein the step (4) comprises a substep: controlling at least one flat knitting machine mangling device to adjust a mangling position based on the gap size after the previous step.

* * * * *